United States Patent [19]

Crews et al.

[11] 3,958,824

[45] May 25, 1976

[54] LIFTING FRAME AND METHODS OF LIFTING PREFABRICATED BUILDING MODULES

[75] Inventors: Roy E. Crews, Allison Park; Eugene D. Legg, West Newton, both of Pa.

[73] Assignee: Westinghouse Electric Corporation, Pittsburgh, Pa.

[22] Filed: Feb. 20, 1975

[21] Appl. No.: 551,562

Related U.S. Application Data

[63] Continuation of Ser. No. 399,599, Sept. 21, 1973, abandoned.

[52] U.S. Cl. ..... 294/67 DA; 294/81 SF

[51] Int. Cl.[2] ..... B66C 1/10; E04G 21/14

[58] Field of Search ..... 294/67 R, 67 AA, 67 D, 294/67 DA, 67 EA, 74, 78 A, 81 R, 81 SF; 52/79, 125, 126, 643, 745; 214/1 H, 12, 14, 15, 38 CA, 392, 394, 396

[56] References Cited

UNITED STATES PATENTS

| | | | |
|---|---|---|---|
| 3,210,113 | 10/1965 | Tantlinger | 294/81 SF |
| 3,404,911 | 10/1968 | Burnett | 294/81 R |
| 3,501,193 | 3/1970 | Gray | 294/67 R |
| 3,596,968 | 8/1971 | Holm | 294/81 SF X |
| 3,596,970 | 8/1971 | Levert et al. | 294/81 R X |
| 3,724,157 | 4/1973 | Miram | 52/745 |

*Primary Examiner*—Evon C. Blunk
*Assistant Examiner*—Johnny D. Cherry
*Attorney, Agent, or Firm*—E. F. Possessky

[57] ABSTRACT

A lifting frame is provided for use in lifting elongated room-size prefabricated building modules and other large, heavy and bulky elongated loads having asymmetrical or lopsided weight distributions in the direction of elongation. The lifting frame includes a pair of generally parallel, side-by-side, spaced apart elongated beams and a pair of cross-brace beams running at right angles to the elongated beams and located therebetween. The elongated beams are adapted to be releasably fastened to the upper portion of the building module or other load with the longer dimension of such beams running in the same general direction as the longer dimension of the building module or other load. The cross-brace beams are adapted to receive and laterally position the lower ends of the cables of a cable-type lifting sling. Structure is provided for releasably fastening the cross-brace beams to the elongated beams at selected ones of a series of different longitudinal locations along the elongated beams for enabling the centerline of lift to be longitudinally aligned with the center of gravity of the building module or other load with a minimum of tipping of the module or load during the lifting process. By using lifting sling cables of proper different lengths on the two sides of the lifting frame, the centerline of lift can also be brought into lateral alignment with the center of gravity for the case of a building module or load having an asymmetrical lateral weight distribution.

37 Claims, 8 Drawing Figures

FIG. 5

LIFTING FRAME AND METHODS OF LIFTING PREFABRICATED BUILDING MODULES

CROSS-REFERENCE TO RELATED APPLICATION

This is a continuation of Ser. No. 399,599, "Lifting Frame And Methods of Lifting Prefabricated Building Modules", filed on Sept. 21, 1973 now abandoned.

BACKGROUND OF THE INVENTION

This invention relates to lifting frames and to methods of lifting prefabricated building modules.

There are various applications wherein it is desired to lift relatively large, heavy and bulky elongated loads having asymmetrical or lopsided weight distributions in the direction of elongation. Typical of these is the erection of various kinds of prefabricated buildings wherein the building is formed, in whole or in part, by elongated room-size prefabricated building modules. In such case, the building modules are fabricated at a factory site, loaded aboard trucks, railroad cars or other means of transportation, transported to the building erection site and then set into place to form the desired building structure. At various points in this process, it is desired to lift the prefabricated building module. At the factory site, for example, it is desired to lift the building module onto the truck or other form of transportation. At the building erection site, it is desired to lift the building module off of the truck or other form of transportation and to set it in place relative to the remainder of the building structure.

A preferred method of lifting prefabricated building modules of the foregoing type is to use a lifting crane or hoisting mechanism which is coupled by means of cables or the like to appropriate cable attachment devices which are located on or form part of the building module. This method is described in varying degrees in the following issued patents:

1. U.S. Pat. No. 1,362,069 granted to J. R. Witzel on Dec. 14, 1920 for a "Building Construction";
2. U.S. Pat. No. 3,103,709 granted to H. C. Bolt on Sept. 17, 1963 for "Building Structures";
3. U.S. Pat. No. 3,162,863 granted to A. L. Wokas on Dec. 29, 1964 for "Prefabricated Bathrooms And Prefabricated Restrooms"; and
4. U.S. Pat. No. 3,461,633 granted to R. L. Ziegelman et al. on Aug. 19, 1969 for a "Prefabricated Building Structure".

A problem not mentioned by the above-listed patents relates to the fact that there will be various situations in which the weight of the building module or the combined weight of the building module plus equipment pre-installed therein is distributed in an asymmetrical or lopsided manner with respect to the direction of elongation of the building module. In other words, the center of gravity of the building module from a weight standpoint may be located a substantial distance to one side of the physical or geometrical centerpoint of the building module. This may occur because the total weight of the building materials nearer one end of the building module is greater than the total weight of the materials nearer the other end. For example, there may be more windows or doors or interior wall partitions nearer one end than the other.

Also, for purposes of expediting the completion of the building to be erected, it is sometimes desirable to pre-install into the building module at the factory site as much of the equipment to be used in the final building structure as is possible. For example, it may be desirable to install at the factory site the various plumbing and toilet fixtures, the heating and air conditioning equipment and various other built-in type fixtures and equipment. For industrial and commercial type buildings, it may even be desirable to install items such as industrial equipment and machinery, business equipment and fixtures and the like in the building modules before they are transported to the building erection site. In general, such pre-installed items will not be evenly distributed from a weight standpoint. For this reason also, the building modules to be transported to and set in place at the building erection site will not, in many cases, have a symmetrical weight distribution.

The building modules being considered may weigh upward of 10 tons or more. They are relatively large, heavy and bulky. A typical module may have, for example, a length of 40 feet, a width of 12 feet and a height of 10 feet. As a consequence, if the centerline of lift of the lifting crane or hoisting mechanism is not located directly above the center of gravity of the building module, there will be a considerable tendency for the building module to tip or tilt when being lifted by means of a cable-type lifting sling. Provision can, of course, be made for preventing slippage of the lifting sling cables relative to the hook of the lifting crane. This, however, would cause the lifting sling cables attached to the heavier end of the building module to carry a greater proportion of the load and might cause breakage of same. Also, where the weight distribution is very lopsided, this would not always prevent some tipping or tilting.

The above-listed patents do not explore this question of lopsided weight distribution. The lifting systems and devices described in these patents are such as would be used where the center of gravity of the building module coincides with the physical centerpoint of the building module.

Another and different field of human endeavor where the lifting of relatively heavy loads is encountered is the freight shipping business wherein freight is shipped in relatively large, box-like cargo shipping containers. One technique sometimes used in handling and lifting such cargo shipping containers makes use of a detachable lifting frame which is releasably fastened to the upper portion of the shipping container. A lifting crane or hoisting mechanism is the coupled to the lifting frame for purposes of lifting and moving the shipping container. This technique for handling cargo shipping containers is described in various ways and to varying degrees in the following issued patents:

1. U.S. Pat. 3,015,407 granted to N. W. Fesmire et al. on Jan. 2, 1962 for "Stacking Cargo Containers";
2. U.S. Pat. No. 3,078,115 granted to L. A. Harlander et al. on Feb. 19, 1963 for a "Lifting Beam";
3. U.S. Pat. No. 3,501,193 granted to R. L. Gray on Mar. 17, 1970 for a "System For Engaging Cargo Containers";
4. U.S. Pat. No. 3,596,970 granted to R. Levert et al. on Aug. 3, 1971 for "Mechanical Gripper Frame Unit Lifting Devices For Parallel-Walled Containers Or The Like"; and
5. British Patent No. 1,160,860 published on Aug. 6, 1969 and describing "Improvements In Or Relating To Adjustable Frames For Lifting Containers".

With the exception of the British Patent, none of these cargo shipping container patents makes any mention of the problem involved in handling loads having asymetrical or lopsided weight distribution. In keeping with this fact, none of the lifting frames described in the first four of these patents includes any features which might be used to compensate for lopsided weight distributions.

The above-listed British Patent describes an adjustable lifting frame for lifting cargo shipping containers having lopsided weight distributions. The lifting frame described in this patent includes a main beam structure which can be releasably fastened to the top of a shipping container. An auxiliary beam is located above and attached to the main beam structure. The auxiliary beam is, in turn, supported by a suspension member in the form of a cradle structure having rollers which engage and support the underside of the auxiliary beam. Such suspension member also includes a crane hook eye located above the auxiliary beam for engagement with the hook of a lifting crane. An electric drive mechanism is provided for causing the cradle-like suspension member to move longitudinally along the auxiliary beam.

The lifting structure described in this British Patent is relatively expensive and complicated. It is not adapted for use with a cable-type lifting sling and, as such, lacks the flexibility and stability of the latter. Also, it does not appear to be very well suited for use in lifting relatively long and relatively heavy building modules.

In accordance with the invention, there is provided a new and improved lifting frame for enabling an elongated room-size prefabricated building module or other large, heavy and bulky elongated load having an asymmetrical or lopsided weight distribution to be lifted with a minimum of tipping, tilting or undesired shifting or such module or load during the lifting process.

The issued patents discussed above were found during the course of a prior art investigation of reasonable scope and effort. They represent what applicants presently consider to be the best of the prior art presently known to them. No representation is made or intended, however, that better prior art does not exist. Nor is any representation made or intended that the foregoing interpretations are the only interpretations that can be placed on these patents.

BRIEF DESCRIPTION OF THE DRAWINGS

For a better understanding of the present invention, together with other and further advantages and features thereof, reference is had to the following description taken in connection with the accompanying drawings, in which.

DESCRIPTION OF THE PREFERRED EMBODIMENT

Figure 1:
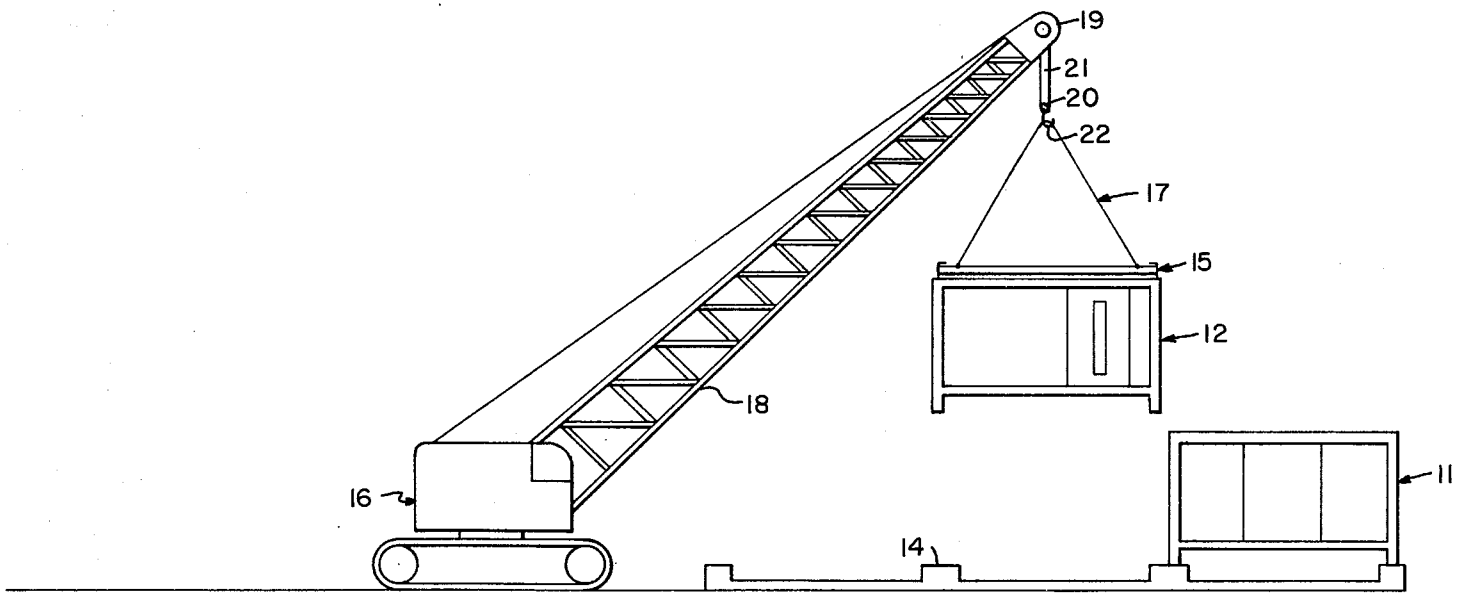
FIG. 1 illustrates in a general manner a method of lifting elongated room-size prefabricated building modules in accordance with the present invention.
Figure 2:
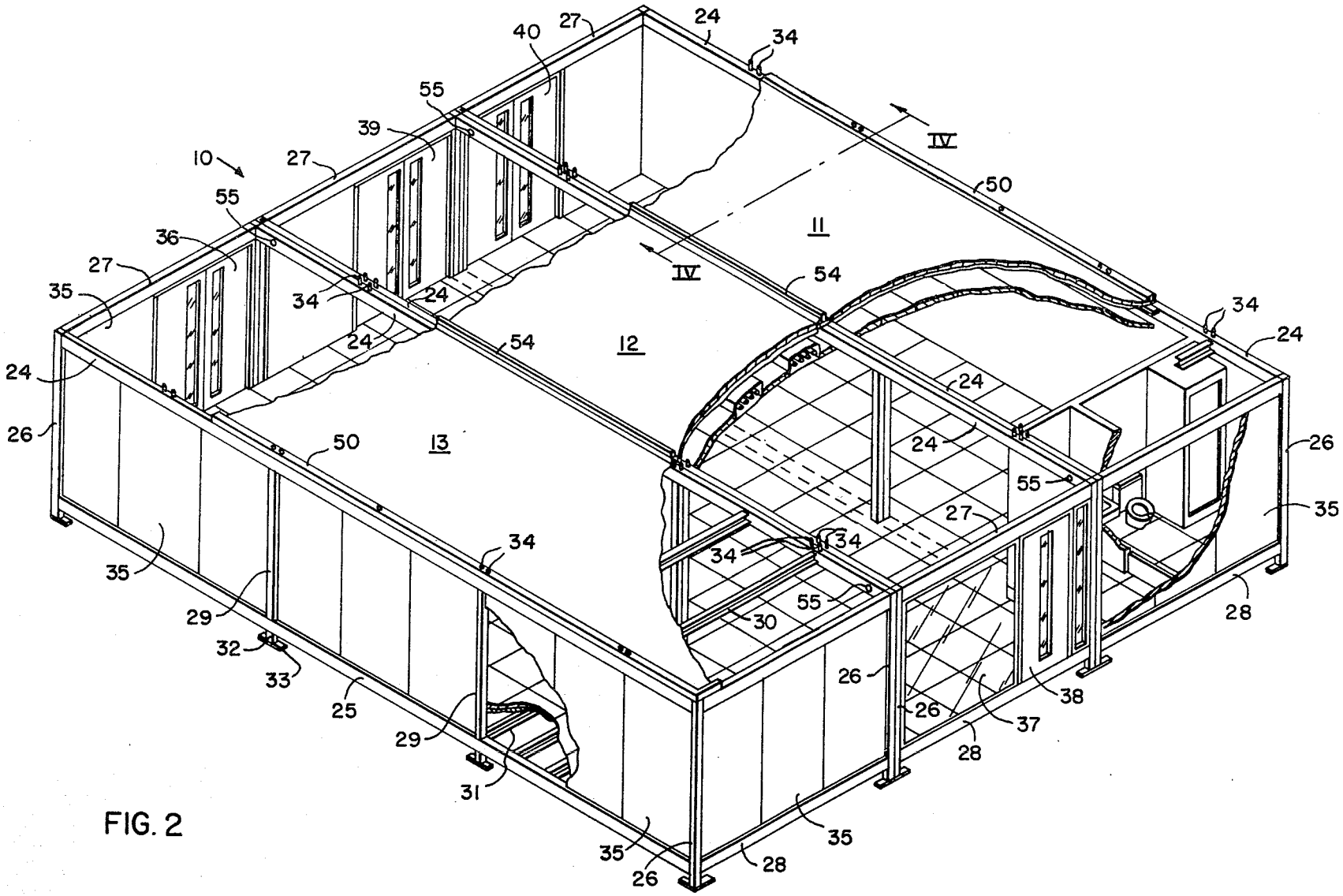
FIG. 2 is a partially cutaway perspective view of a typical multi-module prefabricated building which can be constructed using the method of FIG. 1.

Referring to FIG. 1, there is shown in a general manner a method of lifting elongated room-size prefabricated building modules in accordance with the present invention. FIG. 1 shows a building erection site at which it is desired to construct a complete building structure comprised of three prefabricated building modules. The complete building to be constructed is shown in FIG. 2 and identified by reference numeral 10. The three room-size building modules are identified by reference numerals 11, 12 and 13. The form of building shown in FIG. 2 is intended by way of example only because a relatively wide variety of buildings, both single story and multiple story, can be constructed using these building modules.

As mentioned, FIG. 1 shows the building erection site. It is assumed that the three building modules 11, 12 and 13 were previously fabricated and equipped at a more or less distant factory site and were hauled to the erection site of FIG. 1 by means of some suitable form of transportation such as tractor-trailer type motor vehicles. In FIG. 1, the first building module 11 has already been lifted off of its truck trailer and lowered into place on a previously prepared foundation structure 14. The second building module 12, on the other hand, has been lifted from its truck trailer and is in the process of being lowered into place alongside of the first building module 11. After the module 12 has been set in place, the third building module 13 (not shown in FIG. 1) will be lifted from its truck trailer and lowered into place alongside of the second building module 12 to form the complete building 10 as shown in FIG. 2. After all three building modules are set in place in the side-by-side abutting manner shown in FIG. 2, they are bolted together and the joints therebetween are weatherproofed to form a completely weatherproof building which may be used or inhabited by human beings or used for such other purposes as may be desired.

For purposes of lifting and handling each of the building modules, a detachable lifting frame 15 is temporarily fastened to the top portion of the building module in the manner generally indicated to FIG. 1 for the case of building module 12. The lifting frame 15 and, hence, the building module 12 is lifted and lowered by means of a hoisting mechanism represented by a motorized lifting crane 16 and a cable-type lifting sling 17. The lifting crane 16 includes an upwardly-extending derrick structure 18 capped by a crown block 19. A traveling block 20 is movably suspended from the overhead crown block 19 by lifting cables 21. Attached to and extending below the underside of the traveling block 20 is a load connecting element in the form of a lifting hook 22. The cables of the lifting sling 17 are coupled to the crane hook 22 by hooking same thereon. The free ends, namely, the lower ends of the cables of the lifting sling 17 are fastened to the lifting frame 15 in a manner which will be discussed in greater detail hereinafter.

Figure 3:
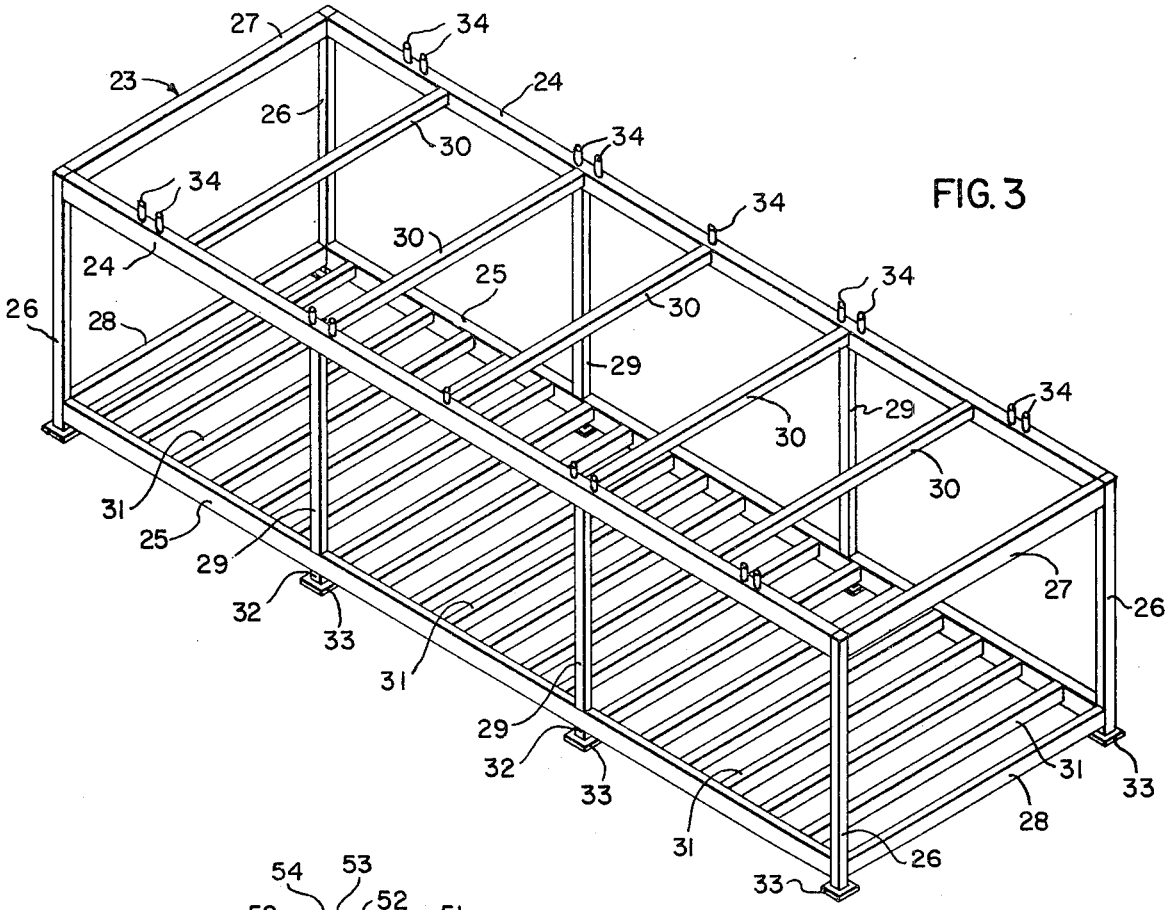
FIG. 3 is a perspective view of the metal frame structure for one of the building modules used in constructing the building of FIG. 2.
Figure 4:
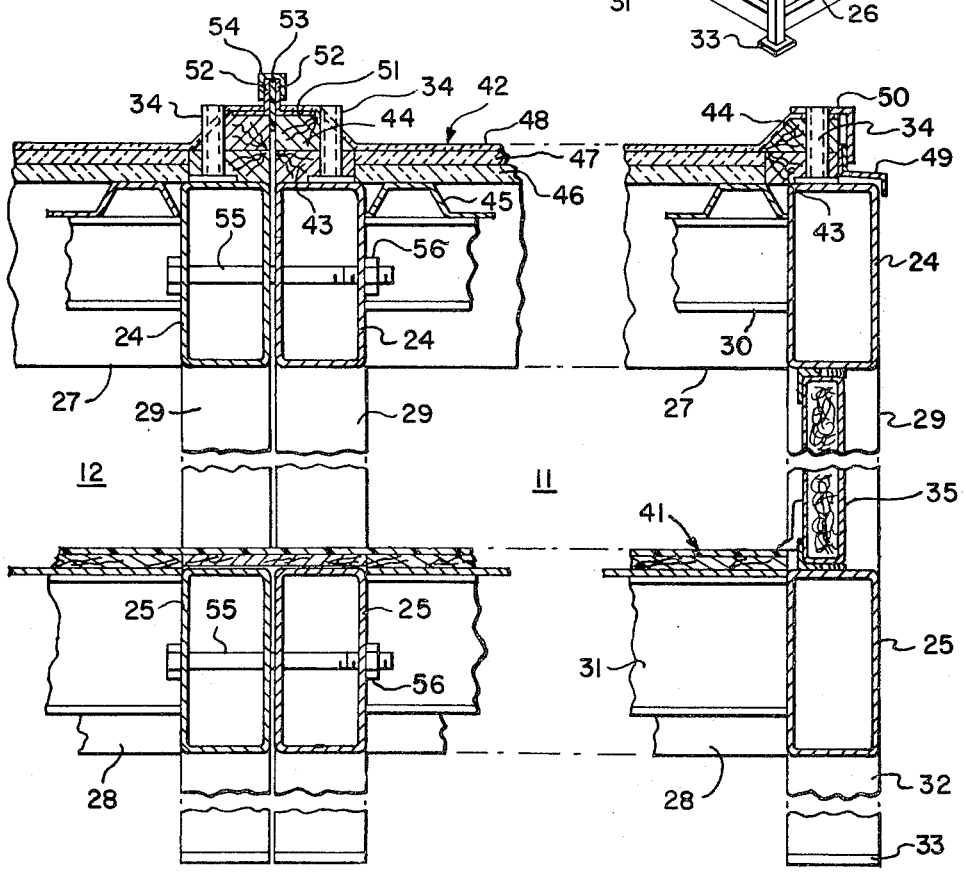
FIG. 4 is an enlarged fragmentary cross-sectional view taken along section line IV—IV of FIG. 2 and showing major structural portions of the FIG. 2 building in a cross-sectional manner.

Referring now to FIGS. 2–4, there is shown in greater detail the physical construction of the representative building structure, namely, the building 10, to be erected. Each of the building modules 11, 12 and 13 includes a transportable, room-size, three-dimensional, rectangular, metal frame structure. The frame structures for the three building modules 11, 12 and 13 are of substantially identical construction. The frame structure for one of these building modules is shown in FIG. 3 and identified, as a whole, by reference numeral 23.

The frame structure 23 of FIG. 3 includes a pair of upper longitudinal beams 24 and a pair of lower longitudinal beams 25 connected between four vertical beams 26 which make up the four corner columns of the frame structure 23. A pair of upper transverse beams 27 and a pair of lower transverse beams 28 are connected between the vertical corner beams 26 at right angles to the longitudinal beams 24 and 25 to complete the perimeter of the three-dimensional frame structure 23. Intermediate vertical beams 29 are secured to and extend between the upper and lower longitudinal beams 24 and 25. All of the foregoing 24–29 are fabricated from elongated hollow steel tubes of rectangular cross section.

Upper transverse steel I-beams 30 run between the upper longitudinal beams 24 intermediate the end transverse beams 27. Lower transverse steel I-beams 31 extend between the lower longitudinal beams 25 intermediate the end transverse beams 28. The joints between all of the foregoing beams 24–31 are formed by welding so as to provide a frame structure 23 which is extremely strong and rigid.

A short downwardly extending leg member 32 is welded to the underside of the lower longitudinal beams 25 below each of the intermediate vertical beams 29. A metal foot plate or bearing plate 33 is welded to the bottom of each of the leg members 32, as well as to the bottom of each of the vertical corner beams 26.

A series of nine upwardly extending lifting nuts 34 is welded to the top side of each of the upper longitudinal beams 24. Such lifting nuts 34 are spaced apart along the length of each such upper longitudinal beams 24 as shown. As indicated in FIG. 4, each of these lifting nuts 34 is of a hollow cylindrical construction and each is internally threaded for purposes of receiving a threaded lifting bolt (not shown) which will be considered in greater detail hereinafter. Such lifting nuts 34 are used for purposes of releasably fastening the lifting frame 15 to the building module for purposes of lifting same.

The frame structure 23 in the present example has a length of 40 feet, a width of 12 feet and a height of 9 feet, 10 inches as measured from the top surface of the upper longitudinal beam 24 to the bottom surface of the corresponding lower longitudinal beam 25. The frame structure 23 has a weight of approximately 5 tons. In some cases such as, for example, the upper floors of multi-story buildings, the leg members 32 and bearing plates 33, as well as the portions of corner beams 26 below the lower longitudinal beams 25, may be omitted.

As indicated in FIG. 2, each of the building modules 11, 12 and 13 includes permanent closure means secured to and closing some but not all sides of the frame structure, any side not so closed being one that will abut another module in forming the complete building 10. These permanent closure means include floor structures, roof structures and wall structures. In the present embodiment, each of the building modules 11, 12 and 13 is provided with a floor structure and a roof structure, with the floor and roof structures for the different building modules being of very nearly the same construction. The wall structures, on the other hand, vary somewhat from module to module. In particular, the three sides of the building module 13 which do not abut or face the middle building module 12 are closed by solid, opaque wall panels 35 which are mounted within the openings or bays defined by the longitudinal, vertical and transverse beams 24–29, with the exception that the wall structure for the left-hand end of the building module 13 includes a double door 36.

The middle building module 12 does not have any permanent closure panels or wall panels on the two long sides thereof because these sides abut or face the outer building modules 11 and 13. The wall structure at the right-hand end of building module 12 includes a glass window panel 37 and a door 38 which are mounted within the opening defined by the vertical beams 26 and the transverse beams 27 and 28. The wall structure at the left-hand end of building module 12 includes one of the solid wall panels 35 and a double-door 39.

The wall structure for the remaining building module 11 is similar to that for the building module 13, the wall structure at the left-hand end of building module 11 including one of the solid wall panels 35 and a double door 40. The other two sides of the building module 11 are closed by the solid, opaque wall panels 35.

Referring now to FIG. 4, there is shown in greater detail the manner of fabrication of the floor, roof and wall structures for the building modules. For point of reference, FIG. 4 is a fragmentary cross-sectional view taken along section line IV—IV of FIG. 2. As such, it shows the cross section of the building module 11 and part of the cross section of the building module 12. Nevertheless, since the same general manner of construction is used for all three building modules 11, 12 and 13, it will be understood that the description of FIG. 4 for the building module 11 is also applicable to the other building modules 12 and 13.

As indicated in FIG. 4, the building module 11 includes a floor structure 41, a roof structure 42 and a wall structure represented by wall panel 35. The floor structure 41 is laid across the lower transverse I-beams 31 and fastened thereto to form a solid floor covering. The roof structure 32 includes elongated wooden boards 43 (for example, two-by-fours) which extend along and are fastened to the top surfaces of the upper longitudinal and transverse beams 24 and 27 to form a perimeter frame for the roof structure 42. Second elongated wooden boards 44 are fastened atop the first boards 43. Appropriate vertically-extending holes are drilled through the boards 43 and 44 for allowing lifting nuts 34 to extend upwardly therethrough as shown.

The roof structure 42 also includes corrugated-type steel decking plates 45 which are laid across and welded to the tops of the upper transverse I-beams 30 to completely close off the area within the confines of the outermost upper horizontal beams 24 and 27. Two layers 46 and 47 of rigid thermal insulation material are laid across and cover the steel decking 45. A layer 48 of tar or asphalt material covers the top of the insulation material 47 and the exposed upper surfaces of the perimeter boards 44 to provide a complete weatherproof covering for the top of the building module 11. Care is taken to prevent any of the tar or asphalt material 48 from flowing into the threaded passages in the lifting nuts 34.

Overlapping metal flashing pieces 49 and 50 are fastened to the outer surfaces of perimeter boards 43 and the upper surfaces of perimeter boards 44 to cover same and to complete the weatherproof seal on the three sides of the building module 11 which do not abut the adjacent building module 12. On the side abutting the module 12, metal flashing 51 is used. Flashing 51 includes an upwardly extending lip 52 for use in providing a weatherproof seal with the adjacent building module 12. After the building modules have been joined together at the building erection site, caulking material 53 is placed between the upwardly extending metal flashing lips 52 running the length of the abutting sides of the two modules 11 and 12. An elongated and inverted U-shaped cap member 54 is then placed down over and secured to the upwardly extending lips 52 to complete the weatherproof seal between the abutting building modules 11 and 12.

The roof structures for the other building modules 12 and 13 are of similar construction to that just considered for the building module 11, with the principal difference being that the two longer sides of the middle building module 12 are constructed in the same manner as the longer side of the building module 11 which abuts the building module 12.

A typical manner of joining together abutting building modules is also shown in FIG. 4. More particularly, after the building modules 11 and 12 have been set in place in a side-by-side manner on the foundations structure 14, the two building modules 11 and 12 are bolted together by means of bolts 55 and nuts 56. Bolts 55 pass through the adjoining upper and lower longitudinal beams 24 and 25 by way of appropriate holes or passageways drilled through the sides thereof. As indicated in FIG. 2, the abutting upper longitudinal beams 24 are bolted together by two such bolts 55, one being located near the left-hand end of the building modules 11 and 12 and the other being located near the right-hand end of the building modules 11 and 12. Similarly, the abutting lower longitudinal beams 25 are bolted together by means of a first bolt 55 (not visible) located near the left-hand end and a second bolt 55 (not visible) located near the right-hand end thereof. Additional nuts and bolts may be used if desired, but the four indicated have been found to be sufficient.

The total weight of each of the building modules 11, 12 and 13, before installation of any plumbing, heating or other equipment, is approximately 10 tons. In addition, as much as some 10 to 15 tons or more of operating equipment and other items may be preloaded into each of the building modules at the factory site. Thus, the weight of a single preloaded building module may be quite large.

Figure 5:
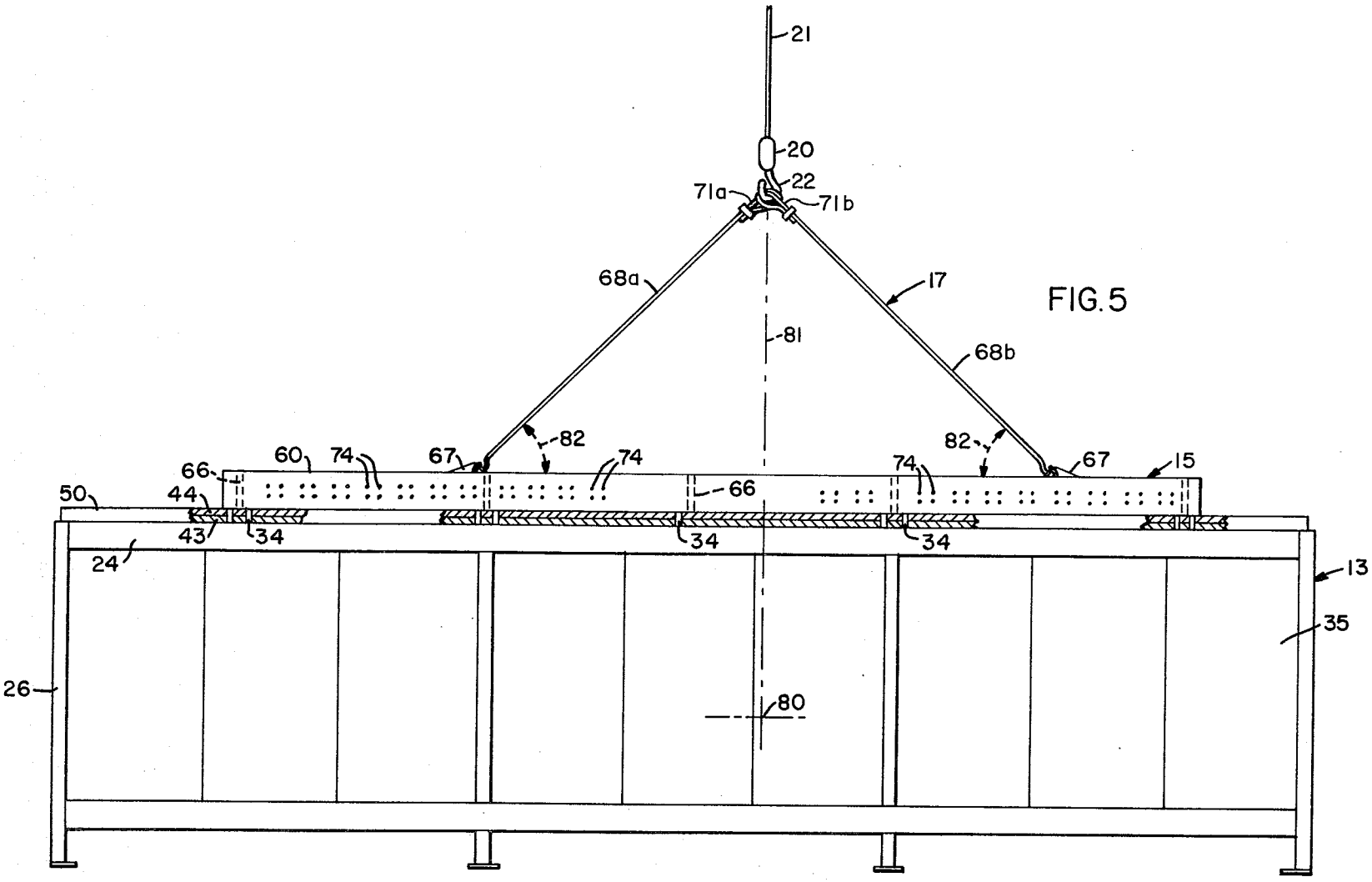
FIG. 5 is an enlarged elevational view showing in greater detail a detachable lifting frame constructed in accordance with the present invention and its manner of use in lifting one of the building modules of FIG. 2.
Figure 6:
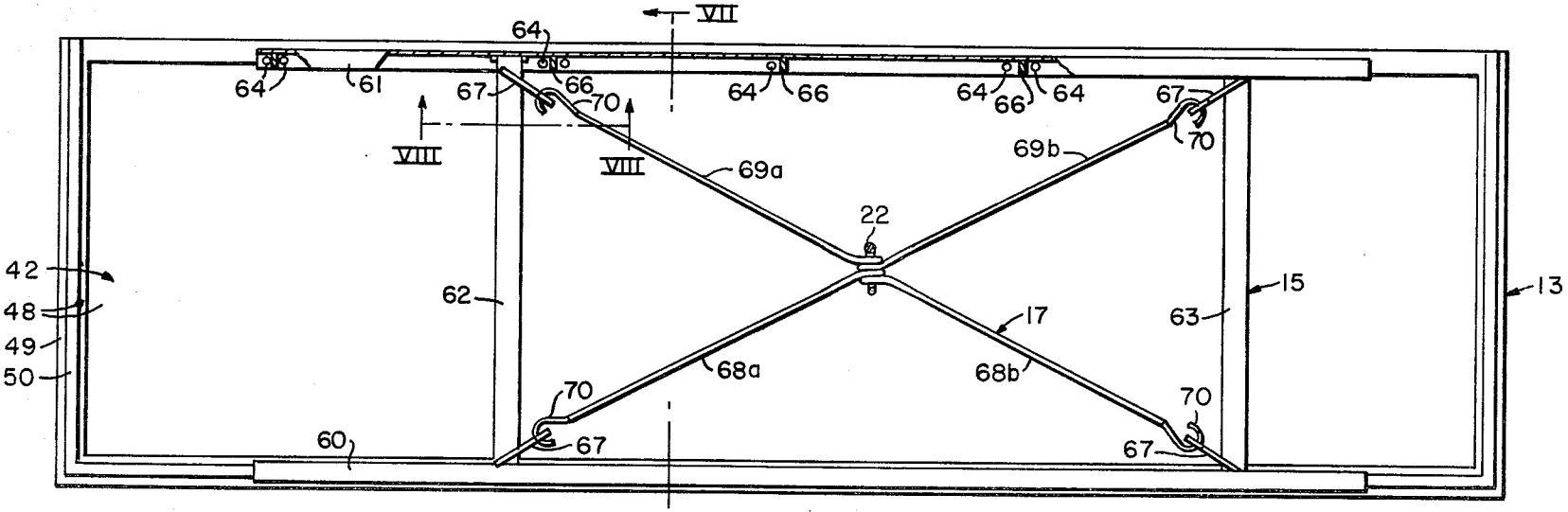
FIG. 6 is a top view of the lifting frame and building module of FIG. 5.

Referring now to FIGS. 5–8, there will now be described in greater detail the construction of the detachable lifting frame 15 and the manner of fastening same to the top of a typical building module which, for sake of example, will be assumed to be the building module 13. As seen in FIGS. 5 and 6, the lifting frame 15 is in the form of an elongated frame structure having its longer dimension running in the same general direction as the longer dimension of the building module 13. The frame structure making up the lifting frame 15 includes a pair of generally parallel, side-by-side, spaced apart elongated beams 60 and 61. Each of the elongated beams 60 and 61 is an elongated steel channel beam. The elongated channel beam 60 is positioned above the nearer upper longitudinal beam 24 of the building module frame structure, while the elongated channel beam 61 is positioned above the farther upper longitudinal beam 24 of the building module frame structure.

The elongated frame structure of the lifting frame 15 also includes a pair of cross-brace beams 62 and 63 running at right angles to the elongated channel beams 60 and 61 and located therebetween. As will be seen, the crossbrace beams 62 and 63 are releasably fastened to the elongated channel beams 60 and 61. When fastened to the elongated channel beams 60 and 61, the cross-brace beams 62 and 63 provide, in conjunction with such elongated channel beams 60 and 61, a rigid frame structure. In the present embodiment, each of the cross-brace beams 62 and 63 is in the form of a steel I-beam.

The lifting frame 15 further includes means for releasably fastening each of the elongated channel beams 60 and 61 to the upper portion of the load to be lifted which, in the present example, is the building module 13. The elongated channel beams 60 and 61 are fastened to the building module 13 by means of the two sets of nine lifting nuts 34 welded to the top of the building module frame structure along each of the two long sides thereof. The manner of fastening or attachment is best seen in the enlarged fragmentary view of FIG. 8. As there indicated, the elongated channel beam 61 runs along the tops of the lifting nuts 34. As previously indicated, lifting nuts 34 are welded to the top of the upper longitudinal beam 24 of the building module frame structure. The channel beam 61 is fastened to the lifting nuts 34 by means of externally-threaded lifting bolts 64 which pass downwardly through leveling washers 65 and holes drilled in the lower flange of the channel beam 61 and are threaded into the internally-threaded lifting nuts 34. Washers 65 are beveled on the underside thereof so as to match the bevel or contour of the lower flange of the channel beam 61. Such leveling washers 65 should not be welded to the channel beam 61.

Figure 8:
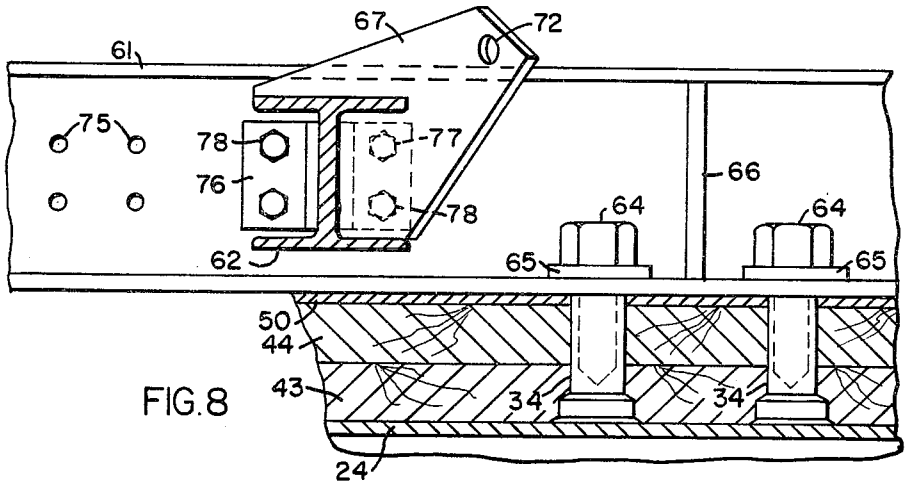
FIG. 8 is an enlarged fragmentary cross-sectional view taken along section line VIII—VIII of FIGS. 6 and 7 and showing in greater detail a portion of the lifting frame and its manner of attachment to the building module.
Figure 7:
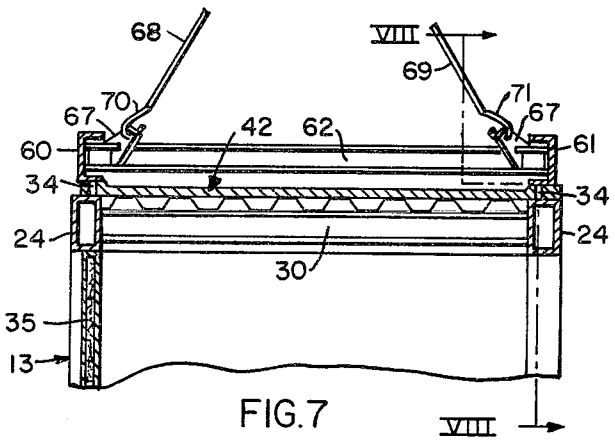
FIG. 7 is a transverse cross-sectional view of the lifting frame and building module taken along section line VII—VII of FIG. 6.

The other elongated channel beam 60 of lifting frame 15 is releasably fastened to its set of lifting nuts 34 by means of lifting bolts 64 (not shown) in the same manner as indicated in FIG. 8 for the channel beam 61. The lifting bolts 64 and the leveling washers 65 for both of the channel beams 60 and 61 are preferably made of steel.

Each of the elongated channel beams 60 and 61 is provided with a series of spaced apart beam stiffening plates 66 for purposes of stiffening and strengthening same. These plates 66 extend across and fill the channels formed by the web and flanges of the channel beam and are shaped to fit the contour of such channel. Plates 66 are made of steel and are welded to the channel beams 60 and 61. As indicated in FIG. 5 for the channel beam 60 these beam stiffening plates 66 are located close to the locations of the lifting bolts 64 and lifting nuts 34 when the lifting frame 15 is in position on the building module 13.

The lifting frame 15 further includes multi-positional cable attachment means located on the frame structure for enabling a cable-type lifting sling 17 to be attached to the frame structure at different sets of longitudinally spaced locations on the frame structure for enabling the centerline of lift of the crane hook 22 to be longitudinally aligned with the center of gravity of the building module 13. In the present embodiment, this cable attachment means includes a plurality of cable attachment elements in the form of cable attachment plates 67 for coupling to and laterally positioning the lower ends of the lifting sling cables relative to the elongated channel beams 60 and 61. This cable attachment means further includes means for enabling the longitudinal locations of the cable attachment plates 67 on the frame structure to be changed. In the present embodiment, this is accomplished by locating the cable attachment plates 67 on the cross-brace beams 62 and 63 and by providing means for releasably fastening the cross-brace beams 62 and 63 at different longitudinal locations along the elongated channel beams 60 and 61.

In the present example, the lifting sling 17 includes a first set of lifting sling cables 68*a* and 68*b*, the lower ends of which are adapted to be coupled or fastened at selected longitudinal locations along one side of the lifting frame 15, namely, along the side defined by elongated channel beam 60. The lifting sling 17 further includes a second set of lifting sling cables 69*a* and 69*b*, the lower ends of which are adapted to be coupled or fastened at selected longitudinal locations along the other side of the lifting frame 15, namely, along the side defined by elongated channel beam 61. In the illustrated embodiment, connecting hooks 70 are secured to the lower ends of the sling cables 68*a*, 68*b*, 69*a* and 69*b*. The upper ends of sling cables 68*a*, 68*b*, 69*a* and 69*b* are provided with loops which are hooked on the lifting crane hook 22 when lifting the load, loops 71*a* and 71*b* for cables 68*a* and 68*b*, respectively, being seen in the elevational view of FIG. 5.

As indicated in FIG. 6, a first pair of the cable attachment plates 67 is located on the cross-brace beam 62, while a second pair of the cable attachment plates 67 is located on the cross-brace beam 63. A typical one of the cable attachment plates 67 is shown on an enlarged scale in FIG. 8. As there indicated, each of the cable attachment plates 67 is provided with a cable attachment hole 72 for receiving one of the hooks 70 attached to the lower ends of the lifting sling cables 68*a*, 68*b*, 69*a* and 69*b*. In other words, sling cable hooks 70 are hooked into the cable attachment holes 72 in the cable attachment plates 67. Alternatively, the lower ends of lifting sling cables 68*a*, 68*b* , 69*a* and 69*b* may be provided with loops similar to those provided at the upper ends of the cables. In this case, shackle devices or the like are employed to couple or fasten the lower cable loops to the cable attachment plates 67.

The cable attachment plate 67 are made of steel. Each of these plates 67 is shaped to engage the upper flange, web and part of the lower flante of the cross-brace I-beam and is welded thereto along the entire line of engagement. The cable attachment hole 72 is located relative to the cross-brace beam 62 (or 63) such that a minimum of torque or twisting action is produced on such cross-brace beam 62 (or 63) when a load is being lifted.

As previously indicated, the lifting frame 15 includes means for releasably fastening the cross-brace beams 62 and 63 to the elongated channel beams 60 and 61 at selected ones of a series of different longitudinal locations along the elongated channel beams 60 and 61. This releasable fastening means include a first series of bolt receiving holes 74 (FIG. 5) located in and spaced apart along the length of the first elongated channel beam 60 and a second series of bolt receiving holes 75 (a few of which are visible in FIG. 8) located in and spaced apart along the length of the second elongated channel beam 61. The complete pattern for the bolt receiving holes 74 in the channel beam 60 is shown in FIG. 5. As there indicated, such pattern includes upper and lower rows of holes 74 which are spaced apart along the entire length of the channel beam 60 except for the middle portion thereof. The pattern and extent of the bolt receiving holes 75 in the second channel beam 61 is the same as that for the first channel beam 60.

The releasable fastening means for the cross-brace beams 62 and 63 further includes bolt receiving means located at each end of each of the cross-brace beams 62 and 63. A typical one of these bolt receiving means is indicated in detail in FIG. 8, which shows the manner in which the end of the cross-brace beam 62 is connected to the channel beam 61. The bolt receiving means illustrated in FIG. 8 includes a pair of L-shaped connector brackets 76 and 77 which are welded to the web of the I-beam cross-brace beam 62 on opposite sides of such web. In particular, one leg of each connector bracket 76 and 77 is fastened to the web, while the other leg extends at right angles to the web and is flush with the end of the cross-brace beam 62. The leg of each connector bracket 76 and 77 which extends at right angles to the web of the beam 62 includes an upper and lower bolt receiving passageway or hole which is drilled through such leg. These holes are spaced and located so as to match up with the bolt receiving holes 75 in the web of the channel beam 61.

The other end of the cross-brace beam 62 and both ends of the cross-brace beam 63 are provided with connector brackets 76 and 77 in the same manner as shown in FIG. 8.

The releasable fastening means for the cross-brace beams 62 and 63 also includes bolt means for engaging the bolt receiving passageways or holes on the cross-brace beam connector brackets 76 and 77 and selected ones of the bolt receiving passageways or holes 74 and 75 on the elongated channel beams 60 and 61 for connecting the cross-brace beams 62 and 63 to the elongated channel beams 60 and 61 to provide a rigid frame structure. A typical set of these bolt means is represented in FIG. 8 by bolts 78. These bolts 78 pass through matching and aligned holes in the connector brackets 76 and 77 and the web of the channel beam 61. Nuts (not shown) are threaded onto the outer ends of the bolts 78 and are tightened down so as to hold the connector brackets 76 and 77 and, hence, the end of the cross-brace beam 62 securely against the web of the channel beam 61. Similar sets of bolts 78 and cooperating nuts are provided at the other end of the cross-brace beam 62 and both ends of the cross-brace beam 63.

Typically, the cross-brace beams 62 and 63 will be fastened or bolted to the elongated channel beams 60 and 61 before the lifting frame 15 is placed atop the building module to be lifted which, in the illustrated case, is the building module 13. The lifting frame 15 is attached to the building module 13 by lifting same and setting it into place atop the buliding module 13 such that the elongated channel beams 60 and 61 are located above the two sets of lifting nuts 34 on the building module 13. Thereafter, the lifting bolts 64 are inserted into the washers 65 and beam flange holes in beams 60 and 61 and into the lifting nuts 34. The lifting bolts 64 are then tightened to the desired degree. Thereafter, the locations of the cross-brace beams 62 and 63 may be adjusted, if necessary, by unbolting same (bolts 78) and moving same to the desired locations, after which they are rebolted to the channel beams 60 and 61. Sling cable hooks 70 are then hooked to the cable attachment plates 67, whereafter the upper loops of sling cables 68*a*, 68*b*, 69*a* and 69 *b* are placed on or hooked on the crane hook 22 for purposes of lifting the building module 13.

The use of multiple sets of cross-brace connector bolt holes 74 and 75 in the channel beams 60 and 61 enables the locations of the cross-brace beams 62 and 63 to be changed or adjusted to better accommodate the weight distribution of the load to be lifted. In particular, cross-brace beams 62 and 63 should be located so that the vertical centerline or centerline of lift for the crane hook 22, traveling block 20 and crane cable 21, when sling cables 68*a*, 68*b*, 69*a* and 69*b* are taut, is longitudinally aligned with the center of gravity of the building module 13. In other words, when building module 13 is being lifted and is in a perfectly horizontal or level (non-tipped) condition, then the centerline of lift of the crane mechanism should be in alignment with the center of gravity of the building module 13 in a longitudinal sense.

The desired longitudinal relationship is illustrated in FIG. 5 for the building module 13. In this case, it is assumed that the center of gravity of the building module 13 is located at a point 80. The vertical centerline or line of lift for the crane hook 22, traveling block 20 and crane cable 21 is indicated by broken line 81. As shown in FIG. 5, this crane lifting vertical centerline 81 passes through the building module center of gravity 80. This is the preferred relationship. It minimizes the chances of the building module 13 tipping or tilting in the longitudinal or lengthwise direction as it is being lifted or lowered.

As indicated in FIG. 5, the longitudinal location of the center of gravity 80 does not coincide with the longitudinal location of the physical centerpoint of the building module 13. This will frequently be the case, particularly where the building modules are preloaded at the factory site with various types of interior fixtures and equipment. Also, where the building modules are preloaded at the factory site, the centers of gravity of the different building modules which form a complete building will frequently not be the same because, typically, the equipment preloaded into the different building modules will be of different sizes and shapes and will be differently located. This difference in the center of gravity from one building module to the next is taken into account by the provision of the releasable fastening means for the cross-brace beams 62 and 63. Such releasable fastening means enables the locations of the cross-brace beams 62 and 63 to be changed from one building module to the next so that, in each case, the crane hook 22 may assume a position directly above the longitudinal location of the center of gravity of the building module with the building module in the desired horizontal or untipped condition. Thus, the releasable fastening means for the cross-brace beams 62 and 63 enables a center of gravity adjustment for the load to be lifted.

In selecting the locations for the cross-brace beams 62 and 63, care should be taken so that the angles formed between the lifting cables 68 and 69 and the top surfaces of the channel beams 60 and 61, such angles being indicated at 82 in FIG. 5, do not become less than approximately 45° when the load is being lifted.

Up to this point, no mention has been made of the case of an asymmetrical or lopsided weight distribution in the lateral or crosswise direction. It has been tacitly assumed that the center of gravity of the building module 13 is not displaced or offcentered in the lateral direction. In many practical applications, however, the center of gravity of the building module or other load will, in fact, also be offcentered in the lateral direction. For this reason, the present invention also includes a method whereby compensation can, if desired, also be provided for such lateral offcentering.

In particular, if there is no lateral offcentering of the center of gravity, then lifting sling cables 68*a*, 68*b*, 69*a* and 69*b* are used which all have the same length. If, on the other hand, the center of gravity of the load is displaced laterally with respect to the longitudinal centerline of the load, then lifting sling cables of different lengths are used on the two sides of the load.

Assume, for example, that the center of gravity of the building module 13 is shifted laterally so that it lies closer to the channel beam 61 than it does to the channel beam 60. Then, in order to provide the desired compensation, the sling cables 69*a* and 69*b* in the second set should be shorter in length than the sling cables 68*a* and 68*b* in the first set. The difference in length should be such that the centerline of lift of the crane lifting elements is in lateral alignment with the center of gravity of the building module 13 when such building module is being lifted and is in a level or untipped condition.

If the center of gravity is displaced laterally in the other direction so as to lie nearer channel beam 60, then the first set of sling cables 68*a* and 68*b* should be shorter in length than the second set 69*a* and 69*b*. In either case, the cables in any given set should be equal in length to one another. In other words, cable 68*a* should be equal in length to cable 68*b* and cable 69*a* should be equal in length to cable 69*b*. The difference is between sets and not between cables in the same set.

While the foregoing description has been primarily concerned with the lifting and handling of prefabricated building modules at the building erection site, it should be borne in mind that the method and devices of the present invention are equally useful at other locations. For example, the lifting frame of the present invention is equally as useful at the factory site for loading the building modules onto the truck trailers or other transport means which will be used to transport same to the erection site.

While there has been described what is at present considered to be a preferred embodiment of this invention, it will be obvious to those skilled in the art that various changes and modifications may be made therein without departing from the invention, and it is therefore, intended to cover all such changes and modifications as fall within the true spirit and scope of the invention.

What we claim is:

1. A detachable and adjustable lifting frame for lifting without longitudinal tilting an elongated building module having a frame which includes first and second elongated frame members, such lifting frame being adapted for use with a lifting harness comprising a plurality of flexible connectors having their upper ends connected at a single point of suspension, comprising, first and second elongated beams, each of said elongated beams being adapted to be fastened to the upper portion of one of opposed sides of the building module, first means for rigidly fastening said first and second elongated beams to the respective first and second frame members at spaced intervals along their lengths, first and second cross-brace beams, each of said cross-brace beams being adapted to be diposed transversely of said first and second elongated beams, second means connected to said first and second cross-brace beams for attaching the lower ends of the connectors of the lifting harness to said first and second cross-brace beams, and third means for releasably fastening said first and second cross-brace beams to said first and second elongated beams to form a rigid frame, said first and second cross-brace beams being positioned to cause the point of suspension to align longitudinally with the center of gravity of the building module.

2. A lifting frame according to claim 1 wherein said first and second elongated beams are channel beams.

3. A lifting frame according to claim 2 wherein the flanges of said channel beams are substantially parallel to the top of the building module and extend from their associated webs toward the inside of the building module.

4. A lifting frame according to claim 3 wherein the webs of said channel beams are substantially parallel one to another.

5. A lifting frame according to claim 4 wherein said cross-brace beams are I-beams, the flanges of such I-beams being substantially parallel to the top of the building module, and the webs of such I-beams being substantially parallel one to another.

6. A detachable and adjustable lifting frame for lifting without longitudinal tilting an elongated building module having a frame which includes first and second elongated frame members, such lifting frame being adapted for use with a lifting harness comprising a plurality of flexible connectors having their upper ends connected at a single point of suspension, comprising, first and second channel beams, each of said channel beams having a flange adapted to be fastened to the upper portion of one of opposed sides of the building module, first means for rigidly fastening said first and second channel beams to the respective first and second frame members at spaced intervals along their lengths, first and second I-beams, each of said I-beams being adapted to be disposed transversely of said first and second channel beams, second means for attaching the lower ends of the connectors of the lifting harness to said first and second I-beams, and third means for releasably fastening said first and second I-beams to said first and second channel beams to form a rigid frame, said first and second I-beams being positioned to cause the point of suspension to align longitudinally with the center of gravity of the building module.

7. A lifting frame according to claim 6 wherein a pattern of bolt receiving holes is located in the web of each of said first and second channel beams at a plurality of longitudinally spaced positions, and wherein said third means comprise, a bolt receiving means secured to each end of said first and second I-beams, said bolt receiving means having a pattern of holes substantially the same as a pattern of bolt receiving holes, a plurality of bolts to extend through the holes of each of said bolt receiving means and through a corresponding pattern of bolt receiving holes in the web of one of said channel beams, and a plurality of nuts threaded to said plurality of bolts to fasten said I-beams rigidly to said channel beams.

8. A lifting frame according to claim 7 wherein the lifting harness comprises four cables, and the second means comprise, first and second cable attachment plates secured to each of said I-beams, each of said cable attachment plates having a hole therein, and four cable hooks, one of said cable hooks to engage the holes of each of said cable attachment plates, and each of said cable hooks being attached to the lower end of a respective one of the four cables of the lifting harness.

9. A lifting frame according to claim 8 wherein said I-beams and said cable attachment plates are of steel, and a cable attachment plate is welded to an I-beam along a line of engagement that includes the upper flange and the web and at least a portion of the lower flange of the I-beam, the hole in the cable attachment plate being located to reduce a torque that is applied to the associated I-beam when a lifting force is applied to the lifting harness at the point of suspension.

10. A building module and a lifting frame attached to the building module to permit a plurality of flexible connectors attached at their upper ends to a single lift point to lift the module and frame without longitudinal tilting comprising, an elongated building module, said building module having a frame including first and second elongated frame members, a first elongated beam, first means for rigidly attaching said first elongated beam to the first elongated frame member at spaced intervals along the length of said first elongated beam, a second elongated beam, second means for rigidly attaching said second elongated beam to the second elongated frame member at spaced intervals along the length of said second elongated beam, first and second cross-brace beams, each of said first and second cross-brace beams being adapted to extend transversely from said first elongated beam to said second elongated beam, means for attaching the lower end of at least one flexible connector to each of said first and second cross-brace beams, and means for releasably connecting said first and second cross brace beams to said first and second elongated beams to form a rigid frame such that the single lift point is longitudinally aligned with the center of gravity of the building module, whereby the module and the attached frame are lifted without longitudinal tilting.

11. A building module and a lifting frame according to claim 10 wherein the first and second elongated frame members are parallel to the long sides of said building module.

12. A building module and a lifting frame according to claim 10 wherein each of said first and second means includes a plurality of threaded bolts for bolting an elongated beam to its respective elongated frame member.

13. A building module and a lifting frame according to claim 12 wherein each of said first and second means includes nine threaded bolts.

14. A building module and a lifting frame according to claim 10 wherein each of said first and second elongated beams is a channel beam having a generally vertical web and upper and lower flanges extending horizontally from the respective upper and lower portions of the web.

15. A building module and a lifting frame according to claim 14 wherein a series of holes is provided in the lower flange of each channel beam, each hole of a series being spaced from adjacent holes of the series in a direction generally parallel to the associated web, and each of said first and second means includes a plurality of threaded bolts to extend through the flange holes of the channel beam, for bolting the channel beam to its associated elongated frame member.

16. A building module and a lifting frame according to claim 15 wherein at least nine holes are provided in the lower flange of a channel beam.

17. A building module and a lifting frame according to claim 15 wherein the webs of the channel beams are generally parallel one to another, and the flanges of the channel beams extend from their associated webs toward the inside of said building module.

18. A building module and a lifting frame according to claim 15 wherein each of said first and second means further includes a plurality of internally threaded nuts securely attached to an elongated frame member, each of such nuts being adapted to receive a corresponding one of the threaded bolts which extends from the top of a lower flange through such flange to engage the nut beneath the lower flange.

19. A building module and a lifting frame according to claim 18 wherein each of said first and second means includes at least nine threaded bolts and nine corresponding nuts.

20. A building module and a lifting frame according to claim 18 further comprising at least one stiffening plate attached to each channel beam, said at least one stiffening plate being substantially vertically disposed and joined along a portion of its periphery with the upper and lower flanges and with the web of its associated channel beam.

21. A building module and a lifting frame according to claim 18 further comprising a leveling washer disposed between the head of a threaded bolt and the upper surface of a lower flange, said washer having a bevel to match the bevel of the upper surface of the lower flange, for improved distribution of the pressure exerted by the bolt head on the flange.

22. A building module and a lifting frame according to claim 10 wherein there are four flexible connectors, and the lower ends of two connectors are attached to each of said first and second cross-brace beams.

23. A method of lifting an elongated building module having a frame which includes first and second elongated frame members, without longitudinal tilting comprising, attaching a first elongated beam rigidly to the first elongated frame member, attaching a second elongated beam rigidly to the second elongated frame member, attaching the upper ends of a plurality of flexible lifting connectors to a single lift point, attaching the lower end of at least one of the lifting connectors to a first cross-brace beam, attaching the lower end of at least one of the lifting connectors to a second cross-brace beam, positioning the first and second cross-brace beams transversely of the first and second elongated beams so that the single lift point aligns longitudinally with the center of gravity of the building module, connecting the positioned first and second cross-brace beams to the first and second elongated beams to form a rigid frame, and applying a lifting force at the single lift point, whereby the module is lifted without longitudinal tilting.

24. A method according to claim 23 wherein each of said steps of attaching the first and second elongated beams includes, bolting an elongated beam rigidly to its associated elongated frame member.

25. A method according to claim 24 wherein each elongated beam is rigidly bolted to its associated frame member at a plurality of points, such points being spaced from one another in a direction generally parallel to the longitudinal axis of the beam.

26. A method according to claim 25 wherein there are at least nine spaced points at which an elongated beam is bolted to its associated frame member.

27. A method according to claim 23 wherein the first and second elongated frame members are generally parallel to one another.

28. A method according to claim 27 wherein the first and second elongated frame members are included in the uppermost portion of the building module.

29. A method according to claim 28 wherein each of the first and second elongated beams is a channel beam having a generally vertical web with an upper flange and a lower flange extending horizontally from the respective upper and lower portions of the web toward the web of the other channel beam, the webs being substantially parallel one to another.

30. A method according to claim 29 wherein each of the lower flanges contains a series of holes therethrough each hole of such series being spaced from adjacent holes in the series in a direction generally parallel to the web and each of said steps of attaching the first and second elongated beams includes, inserting the threaded end of a bolt through each hole of a series to extend through the lower flange and to engage a respective nut securely attached to the elongated frame member, and tightening the bolts to rigidly secure the lower flange of each elongated beam to its associated elongated frame member.

31. A method according to claim 30 further comprising, inserting a beveled washer between each bolt head and the respective lower flange the bevel of the washer matching the bevel of the upper surface of the lower flange, for improved distribution of the pressure exerted by the bolt head on the lower flange when the bolt is tightened.

32. A method according to claim 29 wherein each of the first and second cross-brace beams extends transversely between the webs of the channel beams, each end of a cross-brace beam being adapted to fit vertically between the upper and lower flanges of the channel beam that is adjacent to the end of the cross-brace beam.

33. A method according to claim 32 wherein there are four lifting connectors, and lower ends of two such connectors being attached to each cross-brace beam.

34. A method according to claim 33 further comprising, adjusting the lengths of the lifting connectors to align the single lift point transversely with the center of gravity of the building module to prevent transverse tilting of the building module when a lifting force is applied at the single lift point.

35. A method according to claim 23 wherein there are four lifting connectors of which two connectors are attached to each cross-brace beam.

36. A method according to claim 35 wherein the lifting connectors are of equal length.

37. A method according to claim 23 wherein there are four lifting connectors, two of which are attached to each of the first and second cross-brace beams, and further comprising, adjusting the lengths of the lifting connectors to align the single lift point transversely with the center of gravity of the building module, to prevent transverse tilting of the building module when a lifting force is applied at the single lift point.

* * * * *

Disclaimer 3,958,824.—*Roy E. Crews*, Allison Park, and *Eugene D. Legg*, West Newton, Pa. LIFTING FRAME AND METHODS OF LIFTING PREFABRICATED BUILDING MODULES. Patent dated May 25, 1976. Disclaimer filed July 19, 1977, by the assignee, *Westinghouse Electric Corporation.*

Hereby enters this disclaimer to the remaining term of said patent.

[*Official Gazette September 13, 1977.*]